US007243620B2

(12) United States Patent
Takahashi

(10) Patent No.: US 7,243,620 B2
(45) Date of Patent: Jul. 17, 2007

(54) LIQUID-COOLING DEVICE FOR INTERNAL COMBUSTION ENGINE

(75) Inventor: Eizo Takahashi, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/270,340

(22) Filed: Nov. 9, 2005

(65) Prior Publication Data

US 2006/0096553 A1 May 11, 2006

(30) Foreign Application Priority Data

Nov. 11, 2004 (JP) ..... 2004-328126

(51) Int. Cl.
*F01P 7/14* (2006.01)
*F01P 3/22* (2006.01)
*F01P 5/10* (2006.01)

(52) U.S. Cl. ..... 123/41.1; 123/41.44; 123/41.54

(58) Field of Classification Search ..... 123/41.1, 123/41.44, 41.54, 41.08, 41.09, 41.29
See application file for complete search history.

(56) References Cited

U.S. PATENT DOCUMENTS 4,319,547 A * 3/1982 Bierling ..... 123/41.29
5,095,855 A 3/1992 Fukuda et al.
5,121,714 A * 6/1992 Susa et al. ..... 123/41.1
5,749,330 A 5/1998 Inque et al.
6,314,920 B1 11/2001 Suzuki et al.
6,390,031 B1 5/2002 Suzuki et al.

FOREIGN PATENT DOCUMENTS

JP 2712720 10/1997

* cited by examiner

*Primary Examiner*—Stephen K. Cronin
*Assistant Examiner*—Hyder Ali
(74) *Attorney, Agent, or Firm*—Harness, Dickey & Pierce, PLC

(57) ABSTRACT

A head cooling path diverges from a backflow path at a position between a radiator and a thermostat and is connected with a cylinder head of an engine by bypassing a cylinder block of the engine. A pump circulates the cooling water through the head cooling path, to the cylinder head, when the engine is operated at a high load and/or a vehicle is in a rapid acceleration, so that sufficiently cooled cooling water is supplied directly to the cylinder head.

19 Claims, 4 Drawing Sheets

LIQUID-COOLING DEVICE FOR INTERNAL COMBUSTION ENGINE

CROSS REFERENCE TO RELATED APPLICATION

This application is based on and incorporates herein by reference Japanese patent application No. 2004-328126 filed on Nov. 11, 2004.

Field of the Invention

The present invention relates to a liquid-cooling device for cooling down an internal combustion engine such as an engine of a vehicle. In particular, the present invention relates to a cooling device for the engine, in which an electrically operated pump is additionally provided so that engine cooling water is supplied to the engine independently from engine rotational speed.

BACKGROUND OF THE INVENTION

FIG. 7 is a graph showing a relation between an amount of flow of cooling water and an engine rotational speed for a conventional liquid-cooling device. Conventionally, a mechanically operated pump for circulating the cooling water is operated by receiving a driving force from the engine. Therefore, the amount of the flow of the cooling water is proportional to the rotational speed of the engine, as shown in FIG. 7.

However, such operation of the pump is not optimum for cooling the engine. Some cooling devices have been proposed in the art to improve the operation of the pump. For example, in Japanese Patent No. 2767995, an additional valve and an electrically operated pump are provided to form a new path of the liquid flow in the liquid-cooling device. In Japanese Patent Publication No. 2000-45774, a mechanically operated pump is replaced by an electrically operated pump.

Furthermore, in Japanese Patent Publication No. H8-128559, a flow amount adjusting valve is disclosed, wherein temperature of the cooling water is controlled at a higher value when an engine load is low, to improve fuel consumption ratio.

The mechanically operated pump is installed at a cylinder block of the engine, because the pump is driven by the engine through a driving belt. The cooling water is designed to enter the engine from the cylinder block and goes to a cylinder head through the cylinder block, in order to remove air bubbles produced in the cooling water. When the cooling water flows into the cylinder head from the cylinder block, the cooling water passes through a hole formed in a gasket between the cylinder head and the cylinder block. The hole narrows and accelerates the flow of the cooling water. The accelerated flow cools down the cylinder head efficiently. The mechanical type pump is designed to discharge the cooling water, a flow rate of which is over 100 l/min at a high engine rotational speed of 5,000 to 6,000 rpm. Namely, the mechanical type pump is designed to meet a requirement at the high engine rotational speed, under an assumption that a high engine load is equal to the high engine rotational speed.

As a result, an excessive amount of the cooling water flows through the engine at a low load engine operation, such as an ordinary running of a vehicle, causing a problem that the excessive amount of the cooling water may deteriorate a warming-up performance for the engine. Furthermore, since the cooling water flows in an engine cooling water circuit having a high flow resistance, due to the hole formed in the gasket, a higher pump driving force is required for the engine, causing a problem that a fuel consumption ration is decreased. Furthermore, since the mechanical type pump supplies the cooling water, a flow rate of which is only in proportion to the engine rotational speed, it is rather difficult to quickly cool down the cylinder head portion when the engine load is rapidly increased due to, for example, a rapid acceleration of a vehicle. As a result, it may cause a problem of engine knocking.

SUMMARY OF THE INVENTION

The present invention is made in view of the above problems. Thus, it is an object of the present invention to provide a liquid-cooling device for effectively cooling down a cylinder head of an internal combustion engine, depending on an operational condition of the engine.

A liquid-cooling device of the present invention comprises; a radiator for cooling down cooling liquid by heat exchange between the cooling liquid and air; an inflow path for guiding the cooling fluid from a cylinder head of an engine to the radiator; a backflow path for guiding the cooling liquid cooled down at the radiator to a cylinder block of the engine; a bypass path connected between the inflow path and the backflow path; and a first circulation device (e.g. a mechanically operated pump) provided in the backflow, so that the cooling liquid is circulated through the cylinder block, the cylinder head, the inflow path, the radiator, and the backflow path. A temperature control device (e.g. a thermostat) is provided at a juncture of the backflow path and the bypass path, so that flow amount of the cooling liquid bypassing the radiator is controlled depending on the temperature of the cooling liquid. A head cooling path is further provided, which diverges from the backflow path and is connected with the cylinder head. A second circulation device (e.g. an electrically operated pump) is provided in the head cooling path, so that the cooling liquid can be directly supplied to the cylinder head, without passing through the temperature control device and the cylinder block. The second circulation device is operated and controlled independently from the first circulation device, depending on an engine operational condition.

According to the above feature of the present invention, the cooling liquid which is cooled down at the radiator can be directly supplied to the cylinder head, which is mostly heated by combustion heat of the engine, depending on the operational condition of the engine. Accordingly, cooling efficiency at the cylinder head can be improved, in particular when the engine is operated at a high engine load.

Further, according to the above feature of the present invention, the cooling liquid can be directly supplied to the cylinder head without passing through the temperature control device. Accordingly, the cylinder head can be preferentially cooled down at an accelerating operation of a vehicle, even when the engine is in a warming-up mode, in which most of the cooling liquid is generally circulated not through the radiator but through the bypass path.

Furthermore, according to the above feature of the present invention, the first circulation device which is usually a mechanically operated pump is not necessarily designed to output a high amount of the cooling liquid at a high engine load, and it is not necessary to design the pump under the assumption that the high engine load is equal to a high engine rotational speed. Namely, the pump can be designed to output a lower amount of the cooling liquid and thereby a fuel consumption ratio can be decreased as a result that a lower pump driving force is required.

The second circulation device (e.g. the electrically operated pump) can be likewise designed such that the second circulation device outputs a smaller amount of the cooling liquid, because the cooling liquid can be directly supplied to the cylinder head. As a result, a total pump driving force can be reduced.

Furthermore, it becomes unnecessary to consider an influence of flow resistance generated by the hole formed in the gasket, because the cooling liquid is supplied to the engine in two flow passages, one is a flow passage to the cylinder block while the other is a flow passage to the cylinder head. Furthermore, even in case that one of the first and second circulation devices went into malfunction, the cooling operation for the engine can be continuously performed.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE INVENTION

FIRST EMBODIMENT

Figure 1:
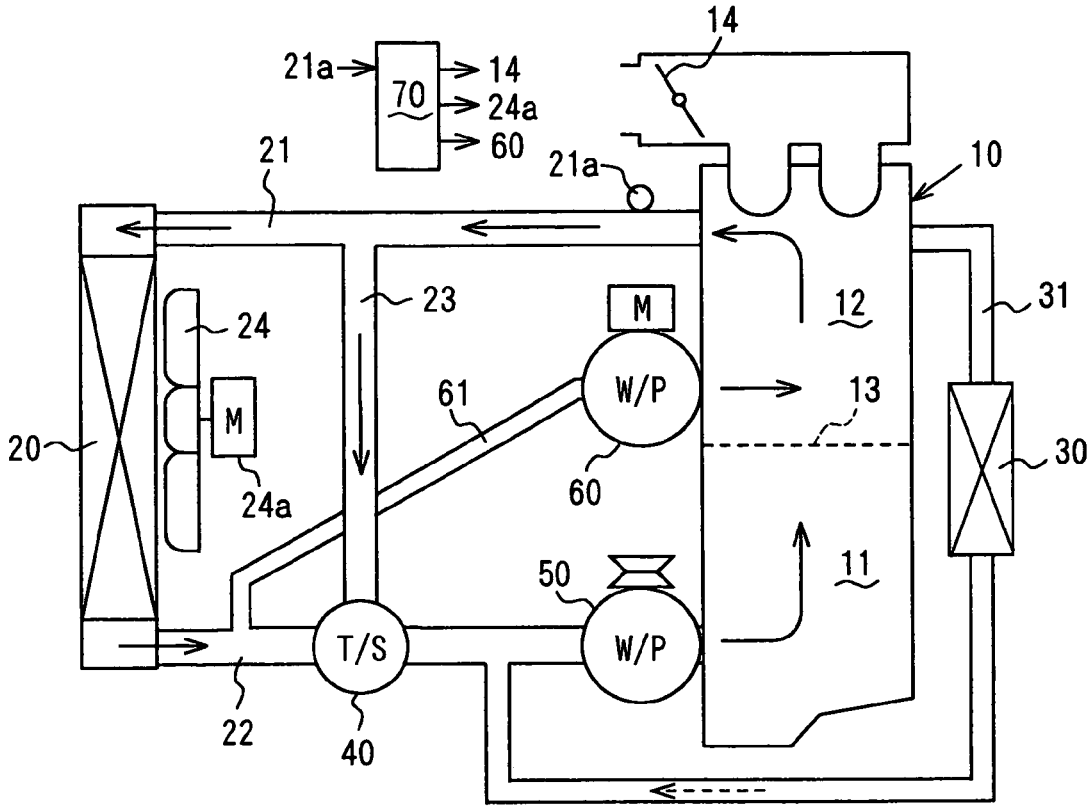
FIG. 1 is a schematic view showing a liquid-cooling device for an internal combustion engine according to a first embodiment of the present invention.

As shown in FIG. 1, in a liquid-cooling system for a vehicle of the first embodiment, a liquid-cooling type internal combustion engine 10 and a radiator 20 are connected with each other through an inflow path 21 and a backflow path 22. The radiator 20 is for performing heat exchange between external air and cooling water for cooling the engine 10.

Specifically, an upstream end of the inflow path 21 is connected with a cylinder head 12 of the engine 10 and the other end (namely a downstream end) is connected with an entrance of the radiator 20. In addition, an upstream end of the backflow path 22 is connected with an exit of the radiator 20 and the other end (namely a downstream end) is connected with a cylinder block 11 of the engine 10.

When cooling water is heated up at the expense of cooling down the engine 10, it goes through the inflow path 21 and enters the radiator. In the radiator 20, the heat exchange cools down the cooling water. Then the cooling water goes through the backflow path 22 and enters the engine 10. In the engine 10, the cooling water moves from the cylinder block 11 to the cylinder head 12 through holes formed in a gasket 13 and thus cools down the engine 10.

A mechanically operated pump (hereafter the first pump) 50 is installed at a position of the backflow path 22. The first pump 50 is connected with the engine 10 through a driving belt (not shown) and is driven by the driving belt. Being driven by the movement of the driving belt, the first pump 50 circulates the cooling water through the engine 10 and the radiator 20.

An end of a bypass 23 is connected with the backflow path 22 at a position between the first pump 50 and the radiator 20 of the backflow path 22. The other end of the bypass 23 is connected with the inflow path 21. Thus, the cooling water in the inflow path 21 can bypass the radiator 20. A well-known wax type thermostat 40 is installed at an intersection of the backflow path 22 and the bypass 23. The thermostat 40 performs as a means for controlling temperature of the cooling water to be supplied to the engine 10. The thermostat 40 opens a passage from the bypass 23 to the backflow path 22 when the temperature of the cooling water in the bypass 23 is lower than a predetermined threshold temperature, and closes the passage when the temperature is higher than the predetermined threshold temperature. In the latter case, the entire cooling water goes through the radiator 20.

A radiator fan 24 is installed at a rear side of the radiator 20 and directs the external air to the radiator 20. In other words, the radiator fan 24 is at the leeward side of the radiator 20. An electrical motor 24*a* makes the radiator fan 24 rotate. The rotation is controlled by an engine controller 70, which is described later.

A water temperature sensor 21*a* is installed in the inflow path 21 and detects the temperature of the cooling water which has just flowed out from the engine 10. The water temperature sensor 21*a* can be replaced by a wall temperature sensor for detecting the temperature of a wall of the cylinder head 12.

A heater core 30 heats up a passenger compartment of the vehicle by means of heat exchange between the air in the compartment and the high temperature cooling water. A path 31 guides the cooling water to the heater core 30.

The engine controller 70 is an engine ECU which receives detection signals from sensors such as the water temperature sensor 21*a* and an acceleration pedal sensor (not shown). In addition, the engine controller 70 outputs an opening signal to a throttle 14 according to the detection signal from the acceleration pedal sensor, calculates the optimum operation for the liquid-cooling device, and outputs control signals according to the calculation to devices, such as the motor 24*a*, and an electrically operated pump (hereafter the second pump) 60 which performs as a second circulation means.

In addition, the liquid-cooling device includes a head cooling path 61, which diverges from the backflow path 22 at a position between the radiator 20 and the thermostat 40 and guides the cooling water from the radiator 20 to the cylinder head 12 by bypassing the thermostat 40 and the cylinder block 11. In addition, the second pump 60 is installed in the head cooling path 61 and circulates the cooling water through the head cooling path 61. The second pump 60 is controlled by the engine controller 70 independently of the first pump 50.

Hereafter, the operation of the liquid-cooling device is described. When the engine 10 is activated, the first pump 50 is rotated by the driving force of the engine 10. The rotation draws the cooling water into the engine 10. The drawn cooling water cools down the engine 10, goes through the engine 10 and the inflow path 21, and then enters the radiator 20. In the radiator 20, the cooling water is cooled down by the heat exchange with the fresh air introduced from outside the vehicle cabin.

Then the cooling water goes through the backflow path 22 and is drawn by the first pump 50 again. When the temperature detected by the water temperature sensor 21*a* is lower than the predetermined threshold temperature, the thermostat 40 opens the path from the bypass 23 to the backflow path 22. The threshold temperature is, for example, in the range of 40–80 degrees C. Therefore, the cooling water in the inflow path 21 bypasses the radiator 20 by going through the bypass 23.

The thermostat 40 is installed at a junction of the backflow path 22 and the bypass 23. The thermostat 40 comprises a temperature sensing portion and a valve, an opening degree of which is changed by the temperature sensing portion. The temperature sensing portion has a movable member which is displaced depending on temperature of the cooling water as a cooling liquid flowing from the bypass 23. The thermostat 40 adjusts an opening degree of a path from the backflow path 22 to the junction and an opening degree of a path from the bypass 23 to the junction in a mutually complementary manner. The thermostat 40 opens the path from the backflow path 22 to the junction when it closes the path from the bypass 23 to the junction. The thermostat 40 controls the temperature of the cooling water in a manner suitable for a normal liquid-cooling type internal combustion engine, which is well-known as an engine for the vehicle. The thermostat 40 adjusts the opening degree of the respective paths, so that the temperature of the cooling water flowing out from the engine 10 is controlled at a predetermined temperature.

For example, characteristic of the temperature sensing portion, more specifically a relation between the temperature and the amount of the displacement of the movable member is so designed that the thermostat 40 provides a function as described below. The thermostat 40 opens the path from the bypass 23 to the junction to its maximum opening degree, and closes the path from the backflow path 22 to the junction to its fully closed position or to its minimum opening degree, during a period in which the detected temperature of the cooling water is lower than a temperature sufficient for operating the engine 10 efficiently.

When the detected temperature becomes higher than 80 degrees C., the thermostat 40 starts closing the path from the bypass 23 to the junction. As the detected temperature is further increased, the thermostat 40 correspondingly decreases the opening degree of the path from the bypass 23 to the junction. When the detected temperature reaches about 90 degrees C., the thermostat 40 fully closes the path from the bypass 23 to the junction or decreases its opening degree to its minimum value, whereas the thermostat 40 opens the path from the backflow path 22 to the junction to its maximum value. As a result, the temperature of the cooling water in the backflow path 22 is lower than the temperature of the cooling water flowing into the cylinder block 11, unless the path from the bypass 23 to the junction is completely closed.

A device including an electrically operated valve, a water temperature sensor and a controller may function as a means for controlling the temperature of the cooling water in place of the thermostat 40. The controller may include a means for controlling an opening degree of the electrically operated valve so that the temperature of the cooling water flowing out from the engine 10 has a predetermined temperature, and a means for changing the predetermined temperature based on operational conditions, such as outside air temperature.

Figure 2:
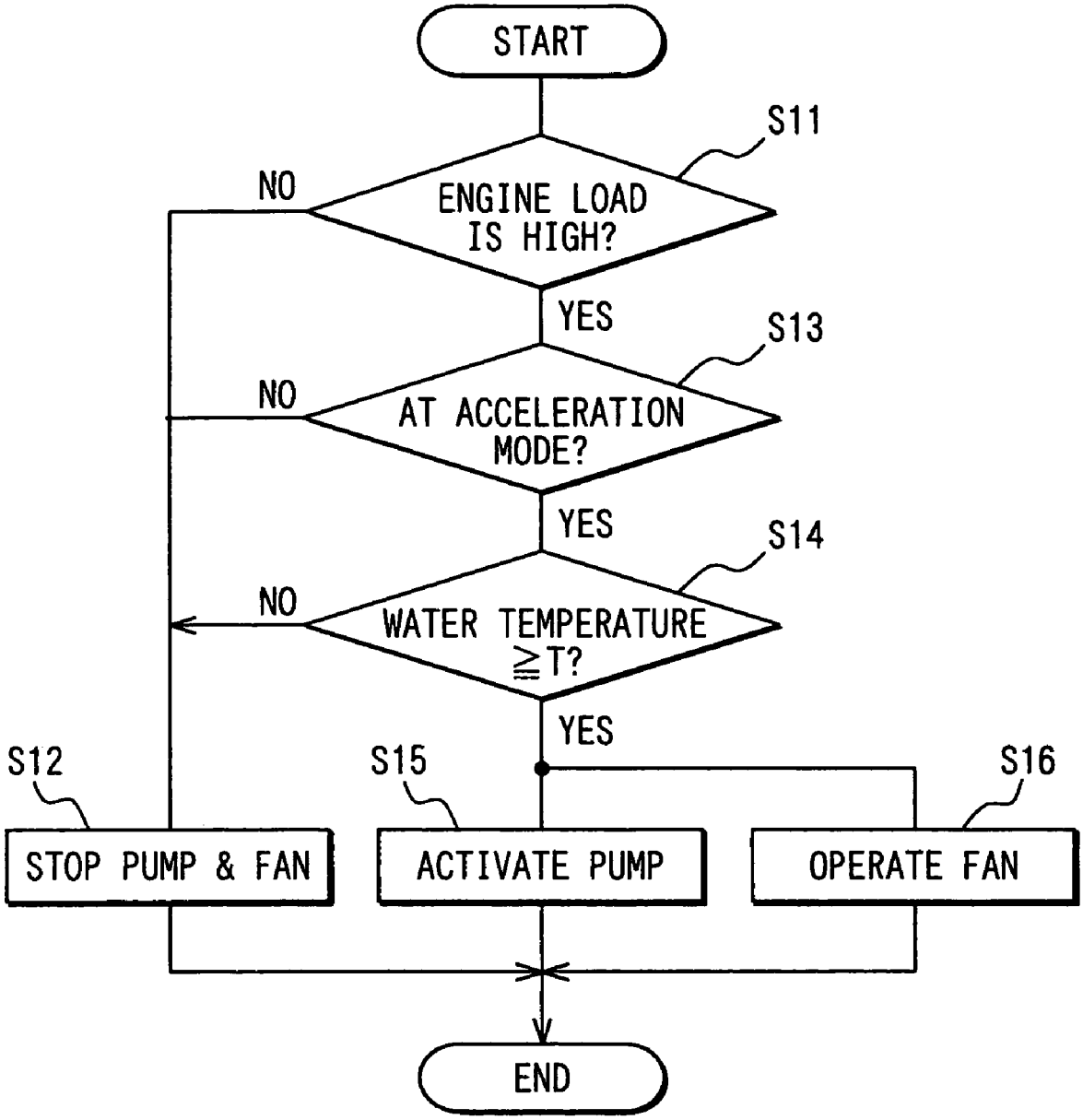
FIG. 2 is a flowchart illustrating an operation of a second pump of the liquid-cooling device.

The engine controller 70 controls the second pump 60 by executing a process shown in FIG. 2. Specifically, at a step S11, the controller 70 determines whether the engine load is higher than a predetermined threshold. The engine load is, for example, the rotational speed of the engine 10.

When the determination is NO, the controller 70 subsequently executes a step S12. When the vehicle is running at an ordinary running condition, in which the engine load is not higher than the predetermined threshold, the determination becomes NO. At the step S12, the controller 70 does not start the operation of the second pump 60 and the radiator fan 24. Thus, the cooling water solely flows through the first pump 50 and cools down the cylinder block 11 and the cylinder head 12.

When the determination of the step S11 is YES, the controller 70 subsequently executes a step S13. At the step S13, the controller 70 determines whether the acceleration of the engine 10 is higher than a predetermined threshold.

When the determination at the step S13 is NO, the controller 70 subsequently executes the step S12. When the determination at the step S13 is YES, the controller 70 subsequently executes a step S14. At the step S14, the controller 70 determines whether the water temperature detected by the water temperature sensor 21*a* is higher than the predetermined threshold temperature T. The threshold temperature T may be set at a value equal to or slightly lower than the above described thermostat responsive temperature, such as 80 degrees, and may represent a temperature that can indicate whether an engine warm up is completed or not.

If the determination of the step S14 is NO, the controller 70 subsequently executes the step S12. When the determination of the step S14 is YES, the controller subsequently executes a step S15 and a step S16. At the step S15, the controller 70 activates the second pump 60. Thus, the cooling water goes through the head cooling path 61 and the second pump 60, and enters the cylinder head 12 by bypassing the cylinder block 11. At the step S16, the engine controller 70 drives the radiation fan 24 to rotate so as to increase the amount of the air passing through the radiator 20.

As described above, the head cooling path 61 diverges from the backflow path 22 at the position between the radiator 20 and the thermostat 40, and the cooling water is directly supplied to the cylinder head 12 to bypass the thermostat 40. In addition, the second pump 60 in the head cooling path 61 is operated independently of the first pump 50 to circulate the cooling water through the head cooling path 61. Moreover, the engine controller 70 controls the operation of the second pump according to the engine load.

Thus, the liquid-cooling device cools down the cylinder head 12, which is heated up by combustion heat, according to the engine load. Therefore, the cooling capability for the cylinder head 12 is improved.

Furthermore, even when the engine 10 is in a warming-up state, the liquid-cooling device can cool down the cylinder head 12 preferentially by supplying the cooling water from the radiator 20 directly to the cylinder head 12, without passing through the thermostat 40. Accordingly, the cylinder head 12 can be cooled down with a quick response to an increase of the engine load caused by, for example, a rapid acceleration. Thus, the efficient cooling down of the cylinder head 12 is achieved.

Figure 3:
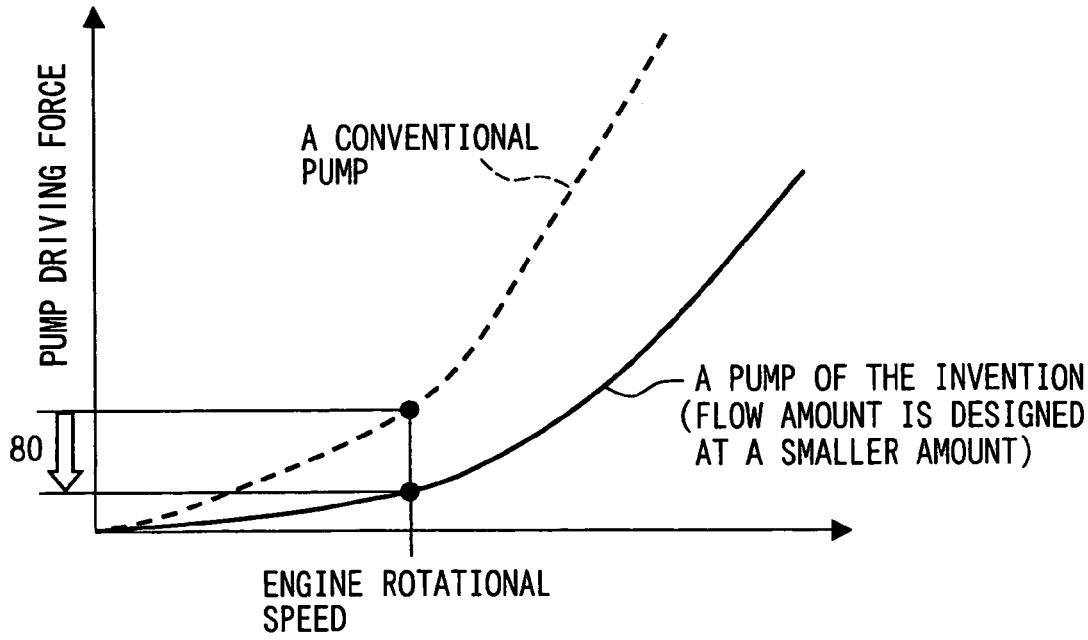
FIG. 3 is a graph showing a pump driving force versus an engine rotational speed.

As shown in FIG. 3, compared to a conventional (mechanical type) water pump (dotted line), the first pump 50 of the embodiment (solid line) does not have to increase the flow of the cooling water even when the engine load is high, for example, the engine rotational speed is high. Thus, the first pump 50 can be made to save its power and the water flow, as specifically shown by an arrow 80 in FIG. 3, and, as a result, fuel efficiency (fuel consumption ratio) of the engine 10 is improved.

In addition, the power (pump volume) of the second pump 60 can be smaller than the conventional water pump, because the cooling water is directly supplied from the second pump 60 to the cylinder head 12. In addition, since the rapid acceleration takes place little when the vehicle is running in the ordinary condition, the driving power of the second pump 60 is totally saved.

It becomes needless to narrow the path of the cooling water in the engine 10 at the gasket. Therefore, the shape of the gasket can be simpler. In addition, even when the second pump 60 is malfunctioning, the first pump 50 still can cool down the cylinder head 12.

The engine controller 70 activates the second pump 60 when the engine load is higher than the predetermined threshold. Thus, the liquid-cooling device preferentially cools down the cylinder head 12 heated by the combustion heat, selectively when the engine load is high. Therefore, the liquid-cooling device reduces the possibility of the occurrence of the knocking of the engine 10.

Figure 4:
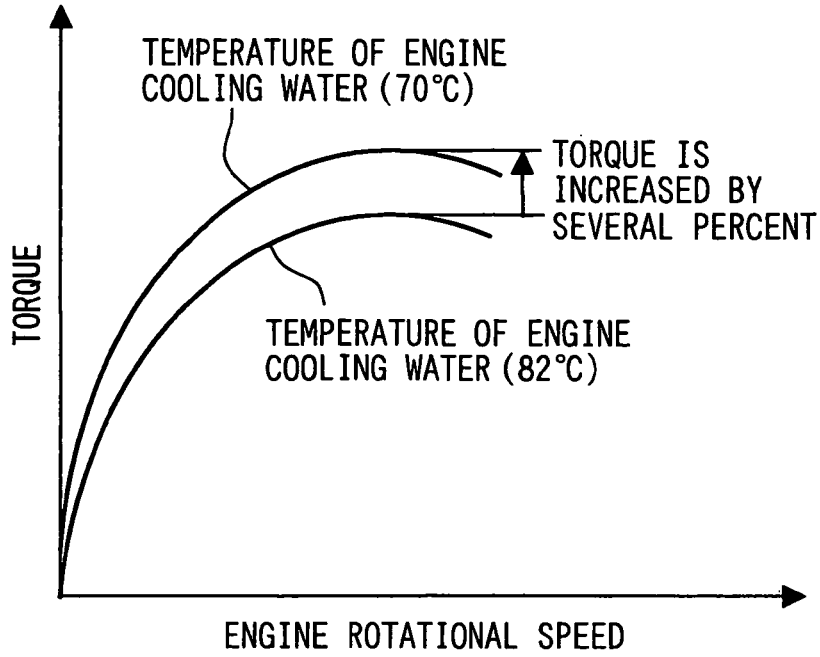
FIG. 4 is a graph showing an engine torque versus an engine rotational speed.

As shown in FIG. 4, with the cooling water of 70 degrees C., the engine 10 produces torque which is several percents larger than that produced with the cooling water of 82 degrees C., at the same engine rotational speed. Thus, it can be said that the lower the temperature of the cooling water becomes, the larger the torque produced by the engine 10 becomes. This tendency comes from two facts. The first one is that when the cooling water temperature is lower, the temperature of the wall of the cylinder head 12 becomes lower and thus tones down abnormal combustion caused by overheat. The second one is that when the cooling water temperature is lower, the weight of the air sucked into the cylinder head 12 becomes larger and thus more fuel can burn in an engine combustion cycle.

The engine controller 70 activates the second pump 60 when the acceleration is higher than the predetermined threshold. In the case that the liquid-cooling device detects the acceleration by means of the detection signal from the acceleration pedal sensor, the liquid-cooling device can cool down the engine 10 with a quick response and improves the acceleration performance of the vehicle.

As above, since the second pump 60 is operated depending on the engine operational condition of the rapid acceleration, the warming-up performance of the engine 10 is improved, by decreasing the amount of the flow of the cooling water through the first pump 50.

The engine controller 70 increases the amount of the air passing through the radiator 20 by controlling the rotation of the radiator fan 24 in conjunction with the operation of the second pump 60. Thus, the liquid-cooling device can more effectively cool down the cooling water flowing directly into the cylinder head 12. As a result, the torque produced by the engine 10 becomes larger and the acceleration performance of the vehicle is improved.

The thermostat 40 in the above embodiment can be replaced with a high temperature type thermostat. The high temperature type thermostat controls the cooling water temperature at a higher value than a normal temperature of the cooling water flowing back into the cylinder block of the engine. The normal temperature means a temperature, for example 80 degrees C., at which the temperature of the cooling water is controlled in a normal liquid-cooling type internal combustion engine. For example, the high temperature type thermostat starts closing the path from the bypass 23 to the junction when the detected temperature becomes higher than 90 degrees C. When the detected temperature reaches about 100 degrees C., the high temperature type thermostat fully closes the path from the bypass 23 to the junction or decreases its opening degree to its minimum value.

Thus, the high temperature type thermostat can provide the cylinder block 11 with the cooling water having the temperature higher than the normal temperature. Since the cooling water with the higher temperature makes it possible to keep a temperature of engine oil at a higher value, the friction loss of the engine 10 is reduced and the fuel-efficiency (fuel consumption ratio) of the vehicle is further improved.

In addition, in the case that the high temperature type thermostat is used, the time period, during which the backflow path 22 is closed by the thermostat for controlling the temperature of the cooling water, is increased (becomes longer), when compared with the case in which the temperature of the cooling water is controlled by the thermostat 40 at the normal temperature. Therefore, a smaller amount of the cooling water flows slowly in the radiator 20, and the cooling water cooled down more sufficiently is supplied from the radiator 20 to the backflow path 22. In addition, the period, in which the cooling water sufficiently cooled down is supplied to the backflow path 22, is elongated and an occurrence ratio of the period is also increased. As a result, it is possible to supply the cylinder block 11 with the cooling water of a relatively higher temperature and to supply the cylinder head 12 with the cooling water of a relatively lower temperature. Therefore, it is possible to maintain the temperature of the cylinder head 12 at a proper value by supplying the cylinder head 12 with the cooling water of the relatively lower temperature, in the case that the temperature of the cylinder head 12 is rapidly increased, for example in the case that rotational speed of the engine 10 is rapidly increased in order to quickly accelerate the vehicle while the engine 10 has not been sufficiently warmed up. Thus, the higher torque can be produced by the engine 10 and the acceleration performance of the vehicle is remarkably improved.

SECOND EMBODIMENT

Figure 5:
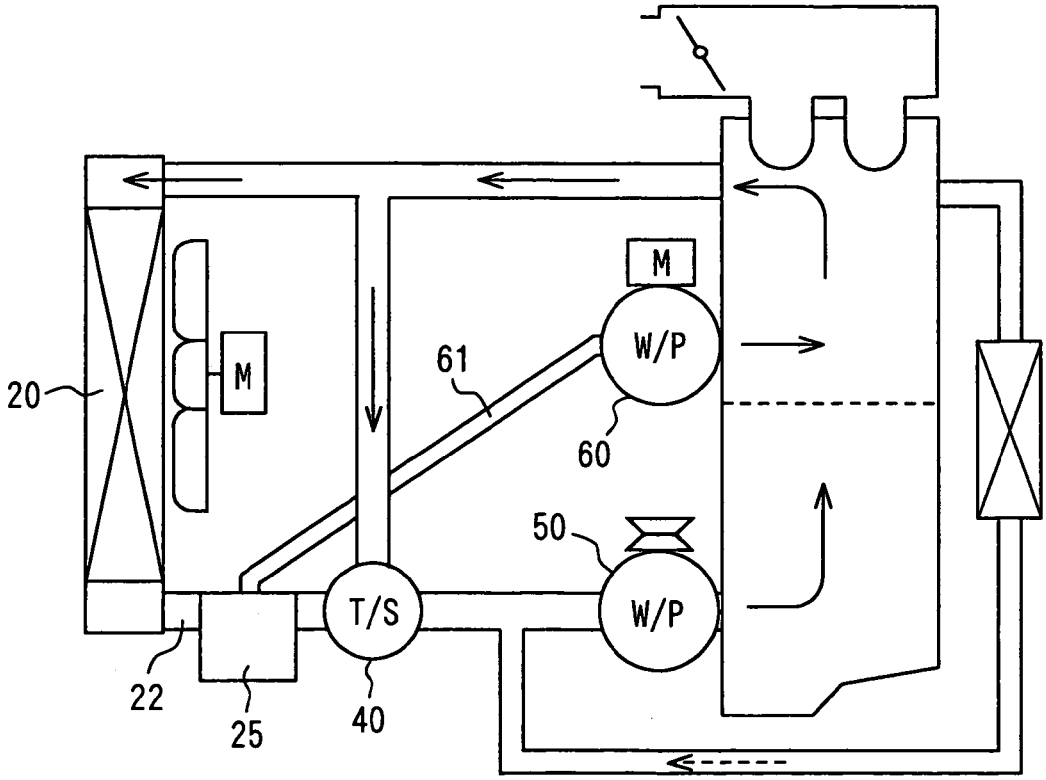
FIG. 5 is a schematic view of a liquid-cooling device according to a second embodiment of the present invention.

The liquid-cooling device of the second embodiment shown in FIG. 5 differs from that of the first embodiment in that a water storage tank 25 is installed at a point where the head cooling path 61 diverges from the backflow path 22. Since the tank 25 stores the cooling water from the radiator 20, the second pump 60 can supply the stored cooling water to the cylinder head 12 with a quick response.

In the case that a volume of the tank 25 is designed to be large enough to supply the cooling water to the cylinder head 12, the tank can store the sufficiently cooled water, when the temperature of cooling water to the cylinder block 11 is controlled at the relatively high value and thereby the flow amount from the radiator 20 to the first pump 50 is reduced. Therefore, the second pump 60 can supply the large amount of the sufficiently cooled water to the cylinder head 12.

THIRD EMBODIMENT

Figure 6:
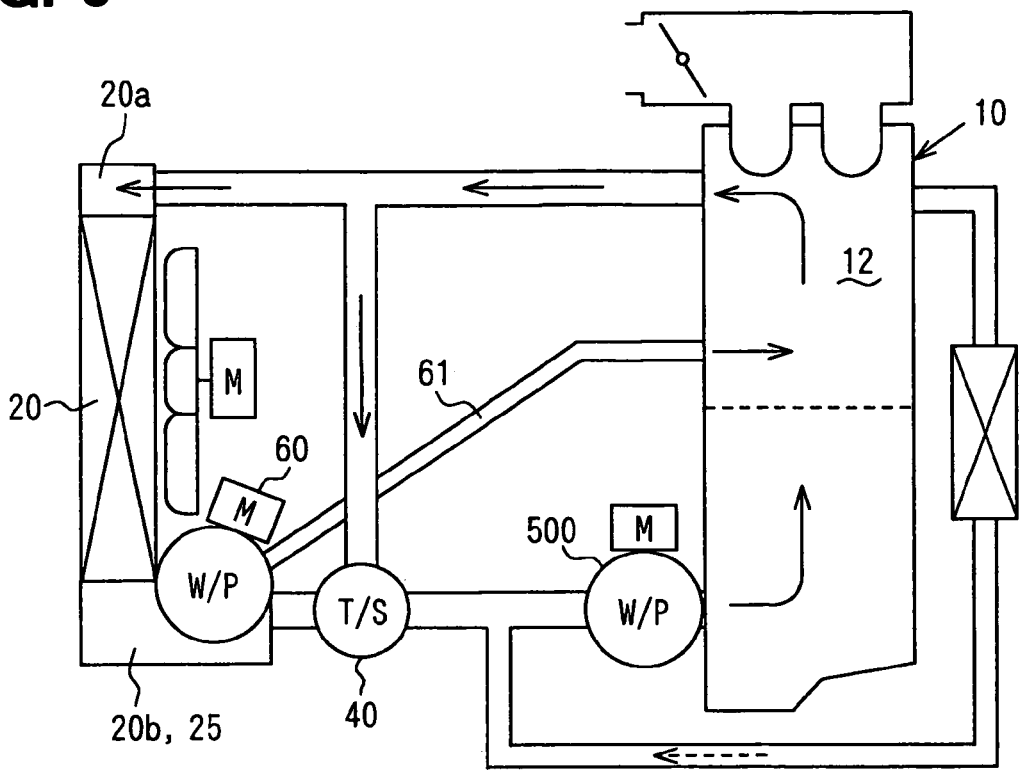
FIG. 6 is a schematic view of a liquid-cooling device according to a third embodiment of the present invention.
Figure 7:
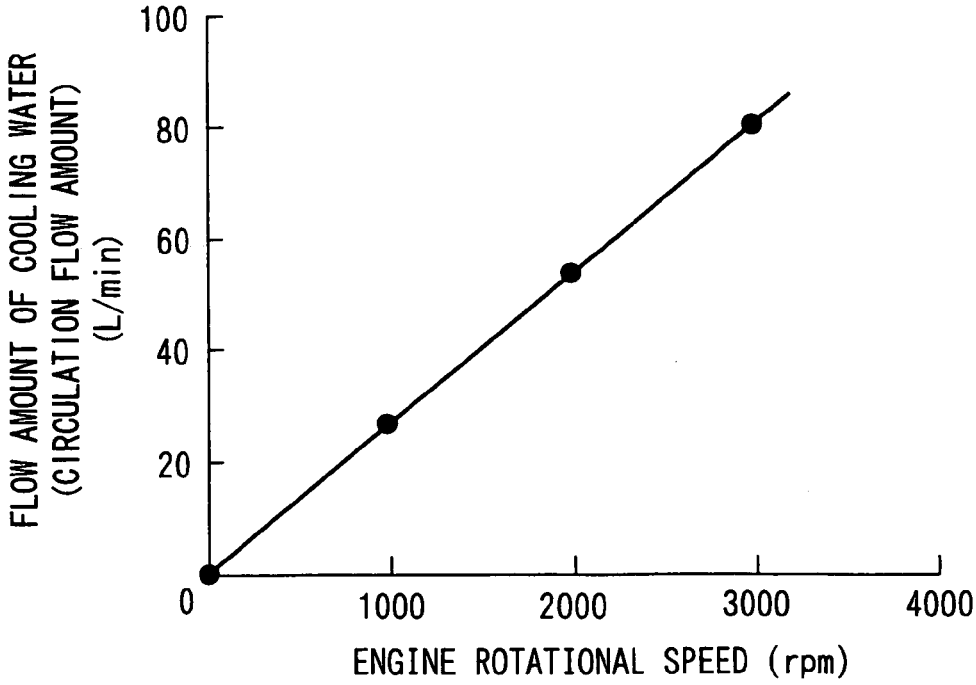
FIG. 7 PRIOR ART
FIG. 7 is a graph showing a flow amount of engine cooling liquid versus an engine rotational speed for a conventional liquid-cooling device.

The liquid-cooling device of the third embodiment shown in FIG. 6 differs from that of the second embodiment in three points described below. The first difference is that the first pump 50 in the second embodiment is replaced by an electrically operated pump 500 which is controlled by the engine controller 70 independently of the engine operation. Thus, the liquid-cooling device supplies the cooling water in a more appropriate manner.

The second difference is that a lower tank 20*b* of the radiator 20 and the water storage tank 25 are made as one unit. Thus, the structure of the liquid-cooling device of the third embodiment becomes simpler, and manufacturing cost of the liquid-cooling device is reduced.

The third difference is that the second pump 60 is installed at the lower tank 20*b,* that is, the tank 25. Thus, the second pump 60 becomes more stable against vibrations of the liquid-cooling device. Therefore, the second pump 60 can be made smaller and at a lower cost.

OTHER EMBODIMENTS

The present invention should not be limited to the embodiment discussed above and shown in the figures, but may be implemented in various ways without departing from the spirit of the invention.

For example, the engine controller 70 may activate the second pump 60 when at least one of the conditions that (i) the engine load is high and that (ii) the vehicle is accelerating is satisfied.

What is claimed is:

1. A liquid-cooling device for an internal combustion engine, comprising:

a radiator for cooling down cooling liquid for a liquid-cooling type internal combustion engine, by means of heat exchange between the cooling liquid and air;

an inflow path for guiding the cooling liquid from a cylinder head of the engine into the radiator;

a backflow path for guiding the cooling liquid cooled down by the radiator into a cylinder block of the engine;

a bypass connected with the inflow path and the backflow path, for making the cooling liquid bypass the radiator;

a liquid temperature controlling means installed at a junction of the bypass and the backflow path, for controlling temperature of the cooling liquid entering the cylinder block by adjusting a ratio between amounts of flows of the cooling liquid from the backflow path and from the bypass;

a first circulation means installed at a downstream of the liquid temperature controlling means for circulating the cooling liquid in accordance with a revolution of the engine;

a controller for controlling an operation of the engine;

a head cooling path diverging from the backflow path at a position between the radiator and the liquid temperature controlling means, for guiding the cooling liquid into the cylinder head; and a second circulation means independently operated of the first circulation means and circulating the cooling liquid through the head cooling path, wherein the controller controls the operation of the second circulation means.

2. The liquid-cooling device according to claim 1, wherein the controller activates the second circulation means when a load of the engine is heavier than a load threshold.

3. The liquid-cooling device according to claim 1, wherein the controller activates the second circulation means when an acceleration of the engine is larger than an acceleration threshold.

4. The liquid-cooling device according to claim 1, wherein the controller increases an amount of the air passing through the radiator in conjunction with the operation of the second circulation means.

5. The liquid-cooling device according to claim 1, wherein the liquid temperature controlling means controls the temperature of the cooling liquid flowing back to the cylinder block at a value higher than a temperature, at which the cooling liquid flowing back into the cylinder block is normally controlled.

6. The liquid-cooling device according to claim 1, wherein the first circulation means is replaced with an electrically operated circulation device installed at the position downstream of the liquid temperature controlling means, for circulating the cooling liquid independently of a revolution of the engine, wherein the controller controls the operation of the electrically operated circulation device.

7. The liquid-cooling device according to claim 1, further comprising:

a liquid storage tank installed at a position where the head cooling path diverges from the backflow path, for storing the cooling liquid from the radiator.

8. The liquid-cooling device according to claim 7, wherein the liquid storage tank and a lower tank of the radiator is made as one unit.

9. The liquid-cooling device according to claim 7, wherein the second circulation means is installed at the liquid storage tank.

10. A liquid-cooling device for an internal combustion engine, comprising:

a radiator for cooling down cooling liquid for a liquid-cooling type internal combustion engine, by means of heat exchange between the cooling liquid and air;

an inflow path for guiding the cooling liquid from a cylinder head of the engine into the radiator;

a backflow path for guiding the cooling liquid cooled down by the radiator into a cylinder block of the engine;

a head cooling path diverging from the backflow path, for guiding the cooling liquid into the cylinder head by bypassing the cylinder block;

a first circuit comprising the cylinder block, the cylinder head, the inflow path, the radiator, and the backflow path;

a second circuit comprising the cylinder head, the inflow path, the radiator, and the head cooling path; and circulation means for circulating the cooling fluid solely through the first circuit when an additional cooling capability for the cylinder head is not required, and for circulating the cooling liquid through the second circuit in addition to circulating the cooling liquid through the first circuit when the additional cooling capability of the cylinder head is required.

11. The liquid-cooling device for an internal combustion engine according to claim 10, wherein the circulation means independently circulates the cooling fluid in the first and second circuits based on an operational condition of the engine.

12. The liquid-cooling device for an internal combustion engine according to claim 11, wherein the operational condition is a load on the engine.

13. The liquid-cooling device for an internal combustion engine according to claim 11, wherein the operational condition is an acceleration mode of the engine.

14. The liquid-cooling device for an internal combustion engine according to claim 11, wherein the operational condition is a temperature of the cooling fluid.

15. A liquid-cooling device for an internal combustion engine for a vehicle, comprising:

a radiator for cooling down cooling liquid for a liquid-cooling type internal combustion engine, by means of heat exchange between the cooling liquid and air;

an inflow path for guiding the cooling liquid from a cylinder head of the engine into the radiator;

a backflow path for guiding the cooling liquid cooled down by the radiator into a cylinder block of the engine;

a head cooling path diverging from the backflow path, for guiding the cooling liquid into the cylinder head by bypassing the cylinder block;

a first circuit comprising the cylinder block, the cylinder head, the inflow path, the radiator, and the backflow path;

first circulation means provided in the first circuit for circulating the cooling liquid in the first circuit;

a second circuit comprising the cylinder head, the inflow path, the radiator, and the head cooling path; and second circulation means provided in the second circuit for circulating the cooling liquid through the second circuit, independently from the operation of the first circulation means, when the temperature of the cooling liquid flowing out from the cylinder head is higher than a predetermined value.

16. The liquid-cooling device for an internal combustion engine according to claim 15, wherein the circulation means independently circulates the cooling fluid in the first and second circuits based on an operational condition of the engine.

17. The liquid-cooling device for an internal combustion engine according to claim 16, wherein the operational condition is a load on the engine.

18. The liquid-cooling device for an internal combustion engine according to claim 16, wherein the operational condition is an acceleration mode of the engine.

19. The liquid-cooling device for an internal combustion engine according to claim 16, wherein the operational condition is a temperature of the cooling fluid.

* * * * *